US009222399B2

(12) United States Patent
Quix et al.

(10) Patent No.: US 9,222,399 B2
(45) Date of Patent: Dec. 29, 2015

(54) LIQUID COOLED INTERNAL COMBUSTION ENGINE WITH COOLANT CIRCUIT, AND METHOD FOR OPERATION OF THE LIQUID COOLED INTERNAL COMBUSTION ENGINE

(71) Applicant: FORD GLOBAL TECHNOLOGIES, LLC, Dearborn, MI (US)

(72) Inventors: Hans Guenter Quix, Herzogenrath (DE); Bernd Brinkmann, Dormagen (DE); Jan Mehring, Cologne (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 13/891,512

(22) Filed: May 10, 2013

(65) Prior Publication Data

US 2013/0298852 A1 Nov. 14, 2013

(30) Foreign Application Priority Data

May 14, 2012 (DE) ..... 10 2012 208 015

(51) Int. Cl.

| | |
|---|---|
| ***F02F 1/10*** | (2006.01) |
| ***F01P 3/02*** | (2006.01) |
| *F01P 7/14* | (2006.01) |

(52) U.S. Cl.

CPC ..... *F01P 3/02* (2013.01); *F01P 2003/024* (2013.01); *F01P 2003/027* (2013.01); *F01P 2007/146* (2013.01); *F01P 2025/33* (2013.01)

(58) Field of Classification Search

CPC . F01P 2007/146; F01P 2025/50; F01P 7/165; F01P 2025/33; F01P 2003/024; F02M 25/0731

USPC ..... 123/41.72, 41.02, 41.17, 41.44, 41.51, 123/434

See application file for complete search history.

(56) References Cited

U.S. PATENT DOCUMENTS

| | | | | |
|---|---|---|---|---|
| 4,381,736 | A * | 5/1983 | Hirayama | F01P 7/164 123/41.1 |
| 4,565,162 | A * | 1/1986 | Seki | F01P 3/22 123/41.08 |
| 5,188,071 | A | 2/1993 | Han | |
| 5,842,447 | A | 12/1998 | Krotky et al. | |
| 5,894,834 | A * | 4/1999 | Kim | F01N 5/02 123/41.29 |
| 6,138,619 | A | 10/2000 | Etemad | |
| 6,470,839 | B2 | 10/2002 | Chang | |
| 6,688,262 | B2 * | 2/2004 | Murakami | F01P 3/20 123/41.1 |
| 6,688,263 | B1 * | 2/2004 | Yamamoto | F02B 77/089 123/41.57 |
| 6,776,127 | B2 | 8/2004 | Osman | |

(Continued)

FOREIGN PATENT DOCUMENTS

| | | |
|---|---|---|
| DE | 102008035955 | 3/2010 |
| DE | 102008042660 | 4/2010 |

OTHER PUBLICATIONS

Website Cylinder Heads, Tektronix, Integrated Publishing, Dec. 9, 2000, 1 Page, http://www.tpub.com/engine3/en32-24.htm.

*Primary Examiner* — Lindsay Low
*Assistant Examiner* — Long T Tran
(74) *Attorney, Agent, or Firm* — Gregory Brown; Brooks Kushman, P.C.

(57) ABSTRACT

A liquid cooled internal combustion engine having a bypass line with a controllable shut off element so that coolant can bypass the cylinder head in certain engine operating conditions. The bypass line branches off from the coolant circuit upstream of the cylinder head and returns to the coolant circuit downstream of the cylinder head.

19 Claims, 1 Drawing Sheet

(56) References Cited

U.S. PATENT DOCUMENTS

| | | | | |
|---|---|---|---|---|
| 6,883,471 | B1 | 4/2005 | Belter et al. | |
| 6,901,891 | B2 | 6/2005 | Suzuki et al. | |
| 6,976,683 | B2 | 12/2005 | Eckert et al. | |
| 7,299,771 | B2 * | 11/2007 | Wei | F01P 3/02 123/41.08 |
| 7,735,461 | B2 * | 6/2010 | Vetrovec | F01P 11/20 123/41.01 |
| 7,921,829 | B2 * | 4/2011 | Hayashi | F01P 3/02 123/41.31 |
| 7,966,978 | B2 * | 6/2011 | Maehara et al. | 123/41.29 |
| 8,256,389 | B2 | 9/2012 | Nomura et al. | |
| 2002/0144666 | A1 * | 10/2002 | Kobayashi | F01P 7/16 123/142.5 R |
| 2010/0326380 | A1 | 12/2010 | Fedeson et al. | |
| 2011/0023799 | A1 | 2/2011 | Lenz et al. | |
| 2011/0197832 | A1 * | 8/2011 | Berkemeier | F02F 1/243 123/41.44 |
| 2011/0296834 | A1 * | 12/2011 | Kuhlbach | F01P 7/165 60/605.3 |

* cited by examiner

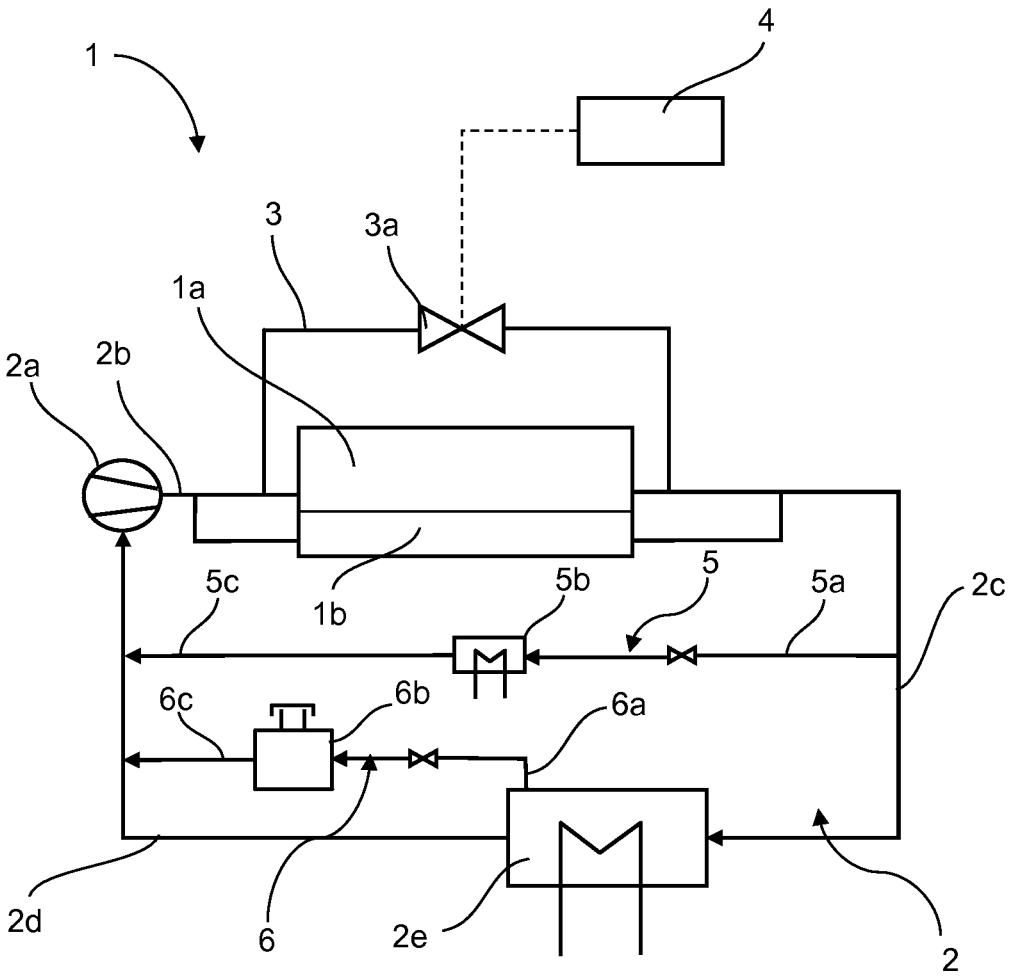
1
4
3
3a
1a
2a
2b
5c
1b
5b
5
5a
2c
6c
6b
6a
2d
6
2e
2

LIQUID COOLED INTERNAL COMBUSTION ENGINE WITH COOLANT CIRCUIT, AND METHOD FOR OPERATION OF THE LIQUID COOLED INTERNAL COMBUSTION ENGINE

CROSS-REFERENCE TO RELATED APPLICATIONS

This application claims foreign priority benefits under 35 U.S.C. §119(a)-(d) to DE 10 2012 208 015.5 filed May 14, 2012, which is hereby incorporated by reference in its entirety.

TECHNICAL FIELD

This disclosure relates to a liquid cooled internal combustion engine having a coolant circuit.

BACKGROUND

Modern internal combustion engines are equipped with cooling systems to prevent overheating which can lead to mechanical failure of engine components. Typically, the cooling systems utilize either air or a liquid coolant to remove excess heat from the engine. However, significantly greater amounts of heat can be dissipated by utilizing a liquid type cooling system. And, since the thermal loading of internal combustion engines is ever increasing in particular as a result of supercharging, a liquid type cooling system is generally provided.

In liquid type cooling systems of internal combustion engines, cooling channels known as water jackets are provided in the cylinder block and/or the cylinder head that allow the coolant to flow through the cylinder head or the cylinder block in order to remove excess heat. The water jackets entail a complex structure that weakens the structure of the cylinder head or block, which experience high mechanical and thermal loads. Also, in a liquid type cooling systems the heat does not first need to be conducted to the surface in order to be dissipated, as is the case with the air type cooling systems. Instead, the heat is dissipated to a coolant, which is generally water provided with additives, in the interior of the cylinder head or block.

A liquid cooled internal combustion engine has a coolant circuit that removes excess heat produced within the engine. A pump is arranged in a feed line of the coolant circuit causing the coolant to circulate. The coolant then flows from the feed line into water jackets of a cylinder block and/or head. Heat is dissipated to the coolant from the interior of the cylinder block and/or head when the coolant flows through the water jackets. Once the coolant flows out of the water jackets thorough a discharge line, the coolant then flows into a heat exchanger where the heat is then extracted from the coolant. The coolant circuit is then completed by a return line which branches off the heat exchanger, after the heat has been extracted from the coolant, and then opens up back into the feed line, where the process starts again. The discharge and feed lines do need not to constitute lines in the physical sense but rather may be part of the water jacket, and formed integrally with the cylinder block and/or head, or they may consist of a coolant inlet housing or coolant outlet housing.

In the heat exchanger, heat is transferred from the liquid coolant to a mass of air flowing across the heat exchanger. To provide an adequate amount of air flow to the heat exchanger, and to assist with the heat transfer, in all operating states but particularly when the motor vehicle is stationary or at low vehicle speeds, the cooling systems of modern motor vehicle drives are increasingly being equipped with high powered fan motors which drive a fan impeller. The fan motors are generally electrical and preferably can be controlled in a continuously variable manner with different loads or rotational speeds.

Additional vehicle systems requiring heat may also be utilized to extract heat from the coolant downstream of the cylinder block and/or head, after it flows through the water jackets in the cylinder block and/or head. For example, a coolant operated heater will utilize the coolant heated in the water jackets of the cylinder block and/or head to heat the air supplied to the passenger compartment of the vehicle, further decreasing the temperature of the coolant.

The water jacket of the cylinder head is often connected to the water jacket of the cylinder block, wherein the head is supplied with coolant from the block and vice versa.

According to the prior art, the heat exchanger provided in the coolant circuit is configured for maximum loading, so that the amounts of heat generated can be dissipated under all operating conditions, in order to ensure the functional reliability of the liquid cooled internal combustion engine.

Nevertheless driving situations arise where the engine cooling system reaches its performance limit especially during acceleration or when traveling on mountain roads. Under these circumstances, the cooling system has to dissipate relatively large amounts of heat because of high loads, while at the same time having a low air mass flow across the heat exchanger. The air mass flow across the heat exchanger will be low in these circumstances because the vehicle traveling at low speeds.

Here, it is not necessarily the component temperature of the engine, or the component temperature of the cylinder head alone, that reaches critical values first. In fact, the coolant itself may overheat downstream of the cylinder head and require cooling even before the internal combustion engine overheats.

Against the background of that stated above, it is an object of the present invention to provide a liquid cooled internal combustion engine where the engine cooling system is optimized during driving conditions where the coolant temperature reaches critical temperatures prior to the engine or individual engine components reaching their critical temperatures.

It is a further object of the present invention to specify a method for operating a liquid cooled internal combustion engine where the coolant temperature reaches critical temperatures prior to the engine or individual engine components reaching their critical temperatures.

SUMMARY

A liquid cooled internal combustion engine is disclosed, which has at least one cylinder head, and a coolant circuit comprising a water jacket integrated in the cylinder head, a feed line to supply the coolant to the water jacket, a discharge line for discharging the coolant from the water jacket and into a heat exchanger, a return line which branches off from the heat exchanger and which opens into a feed line. Additionally, a pump is disposed between the return line and feed line. The liquid cooled internal combustion engine also includes a bypass line in order to bypass the cylinder head. The bypass line, which includes a shut off element, branches off from the coolant circuit upstream of the cylinder head and opens into the coolant circuit downstream of the cylinder head.

The bypass line functions as a short circuit where the coolant can flow past the cylinder head when required, for example if the coolant is overheating. If the coolant temperature $T_{coolant}$ exceeds a critical value, the shut off element of the bypass line is opened or adjusted in the direction of an open position. When the bypass line is adjusted in the direction of the open position, the coolant no longer flows, or significantly less coolant flows, through the cylinder head or the water jacket integrated in the cylinder head. This effectively deactivates the cylinder head or the water jacket integrated in the cylinder head in terms of its function as a constituent part of the coolant circuit. The effect of adjusting the bypass line in the direction of the open position is that no further heat is supplied from the cylinder head to the already overheated coolant. Cooling of the cylinder head is stopped. An additional result from bypassing the cylinder head is that the flow resistance in the coolant circuit is lowered, allowing the pump to deliver more coolant, therefore increasing the coolant throughput through the heat exchanger.

The shut off element of the bypass line is closed again, or adjusted in the direction of a closed position, when the temperature $T_{coolant}$ of the overheated coolant has fallen to a sufficient extent or else the cylinder head reaches a critical component temperature at which cooling is essential. If the cylinder head reaches a critical component temperature,—the overheating of the coolant cannot be given consideration as the cooling of the cylinder head has greater priority.

It is also advantageous to include a continuously adjustable shut off element in the bypass line of the liquid cooled internal combustion engine. A continuously adjustable shut off element allows not only the opening and closing of the bypass line, but also more comprehensive manipulation of the thermal management of the liquid cooled internal combustion engine. For example, during the warm up phase, the amount of the coolant flowing through the coolant jacket of the cylinder head can be adjusted, and thus the amount of heat introduced into the coolant by the cylinder head can be controlled.

Nevertheless, embodiments of the liquid cooled internal combustion engine may also be advantageous where the shut off element can be switched in a two stage fashion.

It may also be advantageous where an embodiment of the liquid cooled internal combustion engine includes a shut off element that can be controlled by means of an engine controller, particularly an electrically operated controller. Nevertheless, the shut off element may also be controlled by a hydraulic, pneumatic, mechanical or magnetic engine controller.

Embodiments of the liquid cooled internal combustion engine may also include a shut off element which can be controlled as a function of a coolant temperature $T_{coolant}$.

A sensor may be provided for detecting and measuring the coolant temperature $T_{coolant}$. The sensor may then provide the coolant temperature as an input variable to an engine controller. Using a sensor for detecting the coolant temperature $T_{coolant}$ is not a problem because the coolant has moderate temperatures that the sensor should be able to withstand even when the liquid internal combustion engine has warmed up. The coolant circuit of an internal combustion engine also has numerous locations, for arranging a sensor without adversely affecting the functionality of the liquid type cooling system.

The coolant temperature $T_{coolant}$ may be calculated exclusively by a simulation. The simulation includes dynamic heat models and kinetic models to determine the reaction heat generated during combustion. The simulation models may also be used to determine the coolant temperature $T_{coolant}$. Simulation however, is not the preferred approach in this case even though the simulated calculation requires no further components to determine temperature, in particular no sensors, which would reduce costs. Even though simulating the coolant temperature $T_{coolant}$ would reduce costs, when the coolant temperature $T_{coolant}$ is determined by means of a simulation, the result is merely an estimated value, which adversely affects the quality of the control of the liquid type cooling system.

If a sensor is used to detect the coolant temperature $T_{coolant}$, it is advantageous if the sensor is arranged adjacent to the outlet of the coolant circuit out of the cylinder head.

Arranging the sensor downstream of the cylinder head, specifically in the region of the coolant outlet out of the cylinder head, ensures that the temperature is detected at a point of the coolant circuit where the coolant has undergone a considerable temperature increase and the risk of overheating exists. It is particularly advantageous in the present case to place the sensor in the region of the coolant outlet of the cylinder head, because here, the maximum coolant temperature will be measured, and then given consideration or regulated.

Alternatively, the sensor for detecting the coolant temperature $T_{coolant}$ may be arranged adjacent to the coolant inlet of the cylinder head. The inlet temperature of the coolant may also be used to estimate the coolant temperature $T_{coolant}$ at a different point of the coolant circuit, in particular at the outlet.

Basically, it is possible to detect and measure the temperature at any one point in the coolant circuit, and then to use the detected temperature to estimate the coolant temperature at any another point in the coolant circuit.

From that stated above, it follows that it is advantageous to place the sensor for detecting the coolant temperature $T_{coolant}$ downstream of the cylinder head and upstream of the heat exchanger in the coolant circuit.

It is also possible to use a sensor to detect a component temperature, in particular a cylinder head temperature $T_{cylinder\text{-}head}$, which can be taken into consideration for estimating the coolant temperature $T_{coolant}$. In this variation of the disclosure, the temperature of the coolant is estimated by using a different temperature, which constitutes a further possibility for determining the coolant temperature.

It is also advantageous for the liquid cooled internal combustion engine to have a shut off element, where the shut off element can be controlled as a function of a component temperature, such as the cylinder head temperature $T_{cylinder\text{-}head}$. The purpose of this embodiment embodiment however, is not directed to determine the coolant temperature $T_{coolant}$ using an estimation based on a component temperature. The intention of this embodiment is to determine if the cylinder head has reached a critical component temperature which makes cooling essential, such that the cooling of the cylinder head has priority over a possible overheating of the coolant. The shut off element is then adjusted in the direction of a closed position in order to increase the coolant flowing through the cylinder head, and therefore increase the cooling of the cylinder head.

It is also advantageous for embodiments of the liquid cooled internal combustion engine to include a pump for delivering the coolant that is provided in the coolant circuit.

Another object of the invention is based is to provide a method for operating a liquid cooled internal combustion engine according to one of the embodiments specified above. This is achieved by a method in which the shut off element is actuated as a function of a coolant temperature $T_{coolant}$ in the coolant circuit.

That which has been stated in connection with the liquid cooled internal combustion engine according to the invention likewise applies to the method according to the invention.

With the method according to the invention, manipulation of the thermal management of the liquid cooled internal combustion engine, specifically that of the heat transfer in the cylinder head, is possible. The coolant is conducted past the cylinder head or through the cylinder head by virtue of the shut off element being opened and closed.

It is not the aim and the purpose, however, of a liquid type cooling arrangement to extract the greatest possible amount of heat from the internal combustion engine under all operating conditions. In fact, what is sought is a demand dependent control of the liquid type cooling arrangement, which, aside from full load, also makes allowance for the operating modes of the internal combustion engine where it is more advantageous for less heat, or as little heat as possible, to be extracted from the internal combustion engine.

Another embodiments of the method may be advantageous where the shut off element is actuated as a function of the maximum coolant temperature $T_{coolant,max}$ occurring in the coolant circuit. In this embodiment, the maximum coolant temperature will serve as the basis for the decision for when the shut off element is opened.

It may also be advantageous in another embodiments of the method to have the shut off element is adjusted in the direction of an open position when the coolant temperature $T_{coolant}$ exceeds a predefined temperature $T_{threshold,1}$. Additionally, when the shut off element may be adjusted in the direction of the open position if the coolant temperature $T_{coolant}$ exceeds a predefined temperature $T_{threshold,1}$ and remains higher than said predefined temperature $T_{threshold,1}$ for a predefined time period $\Delta t_1$.

The introduction of an additional condition for the opening of the shut off element is intended to prevent excessively frequent switching, in particular an opening up of the bypass line, if the coolant temperature only briefly exceeds the predefined coolant temperature and then falls again or fluctuates around the predefined value for the coolant temperature, without the exceedance justifying an activation of the shut off element.

Additional variations may be advantageous where the shut off element is adjusted in the direction of a closed position if the coolant temperature $T_{coolant}$ falls below a predefined temperature $T_{threshold,2}$. Here, for the reasons stated above, variations of the method are advantageous where the shut off element is adjusted in the direction of the closed position if the coolant temperature $T_{coolant}$ falls below a predefined temperature $T_{threshold,2}$ and remains lower than the predefined coolant temperature for a predefined time period $\Delta t_2$.

Other variations of the method may be advantageous where the shut off element is actuated as a function of a cylinder head temperature $T_{cylinder\text{-}head}$, wherein the shut off element is adjusted in the direction of a closed position if the cylinder head temperature $T_{cylinder\text{-}head}$ exceeds a predefined temperature $T_{cylinder\text{-}head,max}$. This variation of the method makes an allowance for the fact that the cylinder head may possibly reach a critical operating temperature at which cooling is essential. The cooling of the cylinder head then has priority over the prevention of overheating of the coolant.

Other variations of the method may be advantageous where the shut off element is opened in the warm up phase after a cold start of the liquid cooled internal combustion engine.

Opening the shut off element during the warm up phase minimizes the fuel consumption of an internal combustion engine, for example by reducing friction losses, which is achieved by the fast heating of the engine oil after cold starting the internal combustion engine. Fast heating of the engine oil during the warm up phase of the internal combustion engine ensures a correspondingly fast decrease in the viscosity of the engine oil, which leads to a reduction in friction and friction losses, in particular in the bearings which are supplied with oil, for example the bearings of the crankshaft.

Fast heating of the engine oil may be assisted by the fast heating of the internal combustion engine itself, which in turn is assisted by extracting as little heat as possible from the internal combustion engine during the warm up phase. In this respect, the warm up phase of the internal combustion engine after a cold start is an example of an operating mode where it is advantageous for as little heat as possible, ideally no heat, to be extracted from the internal combustion engine.

Control of the liquid type cooling system where the extraction of heat is reduced after a cold start in order to realize fast heating of the internal combustion engine may be accomplished by opening the shut off element.

For the operation of an internal combustion engine where a heating circuit is provided which is connected by a supply line and a return line to the coolant circuit, a coolant operated heater being provided in the heating circuit, variations of the method are advantageous where the heating circuit is deactivated by shutting off the supply line when the bypass line is opened.

As a result of the bypassing and deactivating the heating circuit, the flow resistance in the coolant circuit is lowered further, so that the pump delivers more coolant, and therefore the coolant flowing through the heat exchanger also increases.

For the operation of an internal combustion engine having an overflow/ventilation circuit which is connected by a supply line to the coolant circuit, a overflow tank/degas bottle being provided in the overflow/ventilation circuit, variations of the method are advantageous where the ventilation circuit is deactivated by shutting off the supply line, when the bypass line is opened.

As a result of the bypassing and deactivating the overflow/ventilation circuit, the flow resistance in the coolant circuit is lowered further, so that the pump delivers more coolant, and therefore the coolant flowing through the heat exchanger also increases.

The invention will be explained in more detail below on the basis of an exemplary embodiment according to FIG. 1.

BRIEF DESCRIPTION OF THE DRAWINGS

FIG. 1 schematically shows a first embodiment of the liquid cooled internal combustion engine together with the coolant circuit.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIG. 1 schematically shows a first embodiment of the liquid cooled internal combustion engine 1 together with the coolant circuit 2.

The liquid cooled internal combustion engine 1 comprises a cylinder head 1*a* which is connected at an assembly end side to a cylinder block 1*b*.

The coolant circuit 2 comprises a coolant jacket integrated in the cylinder head 1*a*, a feed line 2*b* for the supply of coolant to the coolant jacket, a discharge line 2*c* for discharging the coolant from the water jacket, and a return line 2*d* which branches off from the discharge line 2*c* and which opens into the feed line 2*b*. Also, a heat exchanger 2*e* is provided in the return line. Upstream of the cylinder head 1*a*, a pump 2*a* for delivering the coolant is provided in the feed line 2*b*.

In the liquid cooled internal combustion engine 1 illustrated in FIG. 1, a bypass line 3 is provided which bypasses the cylinder head 1*a*. In order to bypass the cylinder head 1*a*, the bypass line 3 branches off from the coolant circuit 2 upstream of the cylinder head 1*a* and opens back into the coolant circuit 2 downstream of the cylinder head 1*a*. In addition, a shut off element 3*a* is arranged in the bypass line. The shut off element 3*a* is controlled by means of an engine controller 4, wherein the shut off element 3*a* is actuated as a function of a coolant temperature $T_{coolant}$ detected in the coolant circuit 2 downstream of the cylinder head 1*a* by means of a sensor.

The embodiment of the liquid cooled internal combustion engine 1 depicted in FIG. 1 also includes a heating circuit 5 which is connected by a supply line 5*a* to the coolant circuit 2. The supply line 5*a* supplies the coolant to a coolant operated heater 5*b* and a discharge line 5*c* branches off from the coolant operated heater 5*b* and reconnects the heating circuit 5 to the coolant circuit 2. The heating circuit 5 may be deactivated by shutting off a valve in the supply line 5*a*.

The liquid cooled internal combustion engine 1 depicted in FIG. 1 also includes an overflow/ventilation circuit 6 which is connected by a supply line 6*a* to the coolant circuit 2. The supply line 6*a* supplies the coolant to an overflow tank/degas bottle 6*b* and a discharge line 6*c* branches off from the overflow tank/degas bottle 6*b* and reconnects the overflow/ventilation circuit 6 to the coolant circuit 2. The overflow/ventilation circuit 6 may be deactivated by shutting of the supply line 6*a*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A liquid cooled internal combustion engine comprising:

at least one cylinder head;

a coolant circuit comprising at least one coolant jacket integrated into the cylinder head, a feed line for supplying coolant to the coolant jacket, a discharge line for discharging the coolant from the coolant jacket, and a return line having a heat exchanger, the return line having one end coupled to the discharge line and a second end in communication with the feed line; and a bypass line having a shut off element, the bypass line connects the feed line to the discharge line to bypass the cylinder head when the shut off element is in an open state.

2. The liquid cooled internal combustion engine of claim 1, wherein the shut off element is continuously adjustable.

3. The liquid cooled internal combustion engine of claim 1, wherein the shut off element can be switched in a two stage fashion.

4. The liquid cooled internal combustion engine of claim 1, wherein the shut off element is a shut off element that can be controlled by means of an engine controller.

5. The liquid cooled internal combustion engine of claim 4, wherein the shut off element can be controlled as a function of a coolant temperature.

6. The liquid cooled internal combustion engine of claim 5, wherein the shut off element can be further controlled as a function of a component temperature.

7. The liquid cooled internal combustion engine of claim 6, wherein the component temperature is a cylinder head temperature.

8. The liquid cooled internal combustion engine of claim 1, wherein a pump for delivering the coolant is provided in the coolant circuit.

9. A method for operating a liquid cooled internal combustion engine comprising:

flowing a coolant through a cylinder head of an internal combustion engine;

providing a cooling circuit for the liquid cooled internal combustion engine, the cooling circuit having a bypass line with a shut off element capable of bypassing the cylinder head;

providing an overflow/ventilation circuit having an overflow tank/degas bottle, the overflow/ventilation circuit being connected by a supply line to the cooling circuit;

controlling the shut off element so that coolant bypasses the cylinder head as a function of a coolant temperature; and deactivating an overflow/ventilation circuit by shutting off the supply line when the bypass line is opened.

10. The method of claim 9, wherein the shut off element is actuated as a function of the maximum coolant temperature occurring in the cooling circuit.

11. The method of claim 9, wherein the shut off element is adjusted in the direction of an open position if the coolant temperature exceeds a predefined temperature.

12. The method of claim 9, wherein the shut off element is adjusted in the direction of a closed position if the coolant temperature falls below a predefined temperature.

13. The method of claim 9, wherein the shut off element is actuated as a function of a cylinder head temperature, and the shut off element is adjusted in the direction of a closed position if the cylinder head temperature exceeds a predefined temperature.

14. The method claim 9, wherein the shut off element is opened in a warm up phase after a cold start of the liquid cooled internal combustion engine.

15. The method of claim 9, wherein the liquid cooled internal combustion engine further comprises a heating circuit that is connected by a supply line and a return line to the cooling circuit, a coolant operated heater provided in the heating circuit, wherein the heating circuit is deactivated by shutting off the supply line connected to the heating circuit when the bypass line is opened.

16. A method for operating a liquid cooled internal combustion engine comprising:

providing a cooling circuit for the liquid cooled internal combustion engine, the cooling circuit having a bypass line with a shut off element capable of bypassing the cylinder head; and controlling the shut off element of the bypass line so that coolant bypasses the cylinder head as a function of a coolant temperature.

17. The method of claim 16, wherein the shut off element is adjusted in the direction of an open position if the coolant temperature exceeds a predefined temperature.

18. The method of claim 16, wherein the shut off element is adjusted in the direction of a closed position if the coolant temperature falls below a predefined temperature.

19. The method of claim 16, wherein the shut off element is actuated as a function of a cylinder head temperature, and the shut off element is adjusted in the direction of a closed position if the cylinder head temperature exceeds a predefined temperature.

* * * * *